US005754496A

United States Patent [19]

Desrosiers

[11] Patent Number: 5,754,496

[45] Date of Patent: May 19, 1998

[54] DETECTOR EMPLOYING LOGIC CIRCUITRY FOR THE SELECTIVE SCREENING OF SIGNALS (U)

[75] Inventor: Robert L. Desrosiers, Pittsfield, Mass.

[73] Assignee: The United States of America as represented by the Secretary of the Navy, Washington, D.C.

[21] Appl. No.: 69,513

[22] Filed: Aug. 7, 1970

[51] Int. Cl.[6] ..... G01S 3/80

[52] U.S. Cl. ..... 367/124

[58] Field of Search ..... 340/5 D, 6 R, 340/16 R, 16 M; 343/7 PF, 18 E, 112 D; 102/18, 70.2 P, 70.2 R; 367/124, 125; 114/21.3, 23

[56] References Cited

U.S. PATENT DOCUMENTS 2,987,700 6/1961 Hawkins .
3,125,953 3/1964 Foerster .

*Primary Examiner*—Daniel T. Pihulic
*Attorney, Agent, or Firm*—Ervin F. Johnston; Harvey Fendelman; Thomas Glenn Keough

[57] ABSTRACT

The invention disclosed is a run-by detector for a passive homing torpedo. The detector will signal the torpedo that it has passed by the acoustic source under attack, thus enabling the weapon programmer to initiate a reattack or new search maneuver. The detector will, on the basis of measured acoustic energy level, differentiate between the run-by of a real target and the run-by of a high-energy jammer or decoy.

The detector is a logic circuit which makes use of two indications which occur when an acoustic source is passed by a relatively short range. First, the source which had been close to the axis of the torpedo motion (boresight) will move rapidly in angle to well off weapon boresight. Second, the measured acoustic level of the source drops at pass-by due to the highly directional character of the typical torpedo's transducer receiver. Appropriate thresholds are applied to these two indicator signals; and their near coincident occurance in time is the basis for a run-by detection. An additional circuit inhibits the detector if a pulsing countermeasure is in the near environment, since such countermeasure pulses could invalidate the source level excursion clue described above.

5 Claims, 1 Drawing Sheet

FIG. 1
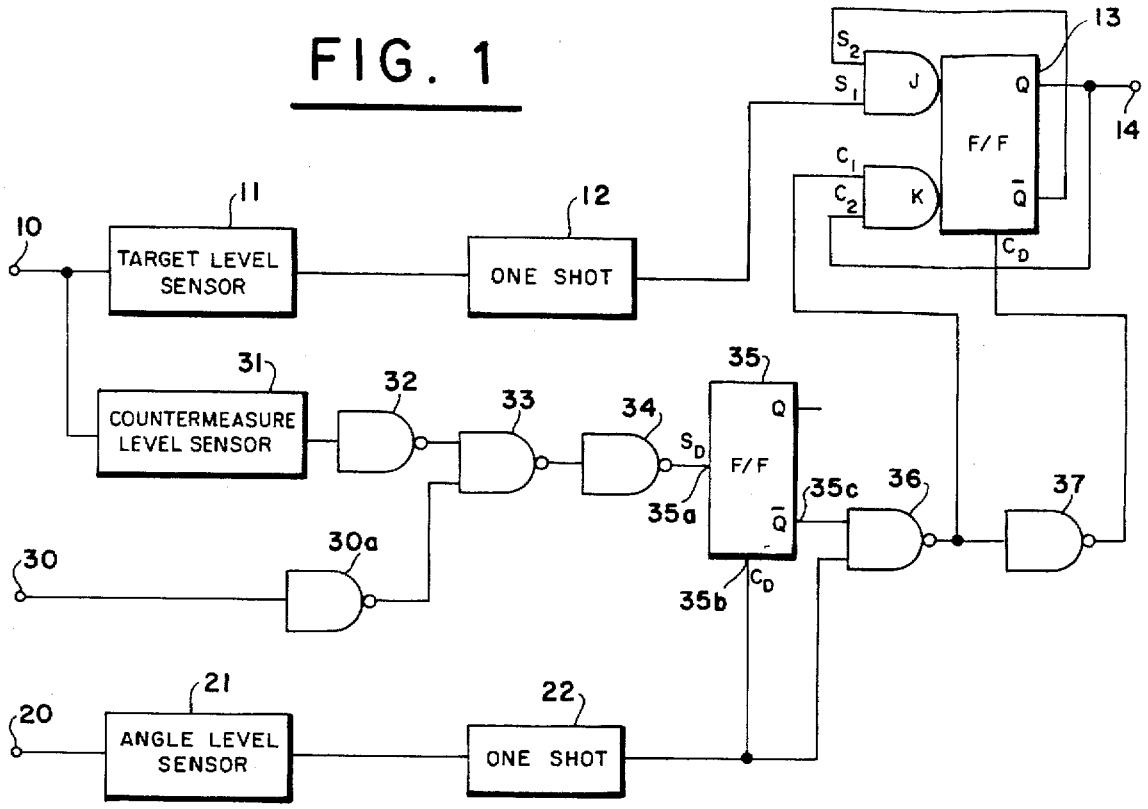
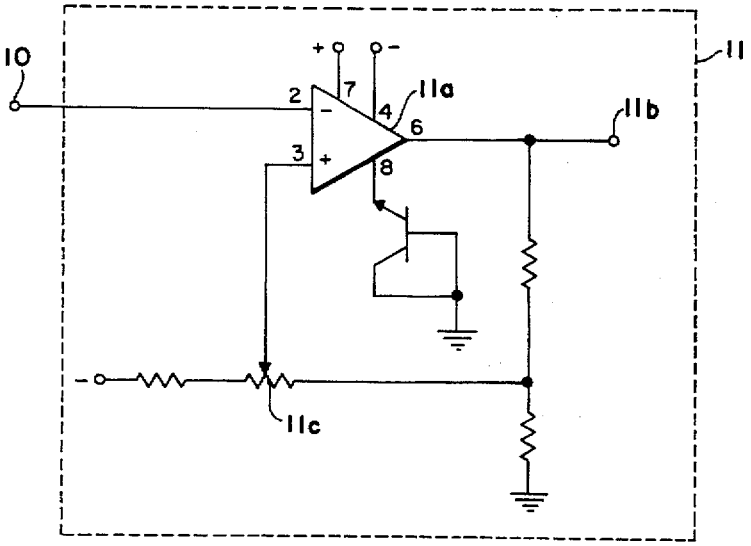
FIG. 2

DETECTOR EMPLOYING LOGIC CIRCUITRY FOR THE SELECTIVE SCREENING OF SIGNALS (U)

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

Unlike active homing torpedoes, passive acoustic torpedoes have no built-in measure of range to the target. Thus, if the passive torpedo should miss or pass by the source under attack, no ready indication exists which could initiate a second attack or reattack upon the target. Obviously, it is desirable to avoid reattacks upon decoy or countermeasure sources so that run-by of such a source should be distinguished from run-by of a real target if possible. Additionally, since a false indication of a target run-by could cause a premature or abortive reattack, assurance of a true run-by condition is mandatory.

SUMMARY OF THE INVENTION

The present invention is directed to providing a circuit for passively sensing and indicating a target run-by and includes a first target level sensor providing trigger signal when target signals fall below a predetermined level. A second sensor, an angle level sensor, provides an azimuth beamwidth pulse when the source of target signals emanates from an azimuth outside of the torpedo's main receive beam. Near time coincidence of the two output signals provides an indication of target run-by and responsive machinery within the torpedo reinitiates another attack. A third sensor detects the presence of high energy decoy signals and inhibits the indication of target run-by if the source energy is above a level much greater than the magnitude of the expected target energy. An indication of target run-by is also inhibited when signals due to pulsing type counter-measures are received, since such countermeasures when off-axis could produce a false run-by indication.

BRIEF DESCRIPTION OF THE DRAWINGS

FIG. 1 is a block diagram of the invention.

FIG. 2 is a schematic diagram of a representative comparator circuit capable of being appropriately modified for use as the three sensors.

DESCRIPTION OF THE PREFERRED EMBODIMENT

Referring to the drawings, FIG. 1 depicts, in block form, the functional properties of the elements forming the instant invention. A source level signal input terminal 10 receives an analog signal proportional to received acoustic energy. For example, the analog signal could be the automatic gain control (AGC) voltage in a typical torpedo acoustic receiver. Such AGC circuitry is widely employed for signal normalization in homing torpedoes. A target level sensor 11 receives the source level analog voltage from the input terminal and switches to an "on" condition when the magnitude of the level falls below a predetermined level. Having the level of the source fall below the predetermined magnitude from a higher level is one indication that a target source has been bypassed (missed).

A typical circuit for the target level sensor is the voltage comparator shown in FIG. 2. It consists, primarily, of a commercially available operational amplifier 11*a*, an LM201, receiving, the normalized target signals from terminal 10. The exact magnitude at which the operational amplifier becomes saturated, impressing a +6 volt DC "on" signal on the output 11*b*, is determined by the setting of a potentiometer 11*c*. In the present application, sensor 11 was set to turn "on" when the incoming target signals were less than −1.9 volts DC and "off" for inputs more positive than −1.8 volts DC.

Following the sensor, a one-shot multivibrator 12 is actuated when receiving the "on" signal to produce a trigger pulse. The trigger pulse is fed to a conventionally connected J–K flip-flop 13 to set the flip-flop and indicate a target run-by signal provided the flip-flop has been enabled in a manner to be set out below.

A second input terminal 20 receives and passes an analog voltage proportional to the angle to the source from weapon boresight. Such a voltage is included in modern homing torpedoes as the error voltage to the weapon steering servomechanisms. This steering error voltage is usually derived from a phase or amplitude comparison of signals received by two or more physically separate transducer elements or arrays of elements at the torpedo nose.

In FIG. 1, the source angle analog signal is fed to an angle level sensor 21 which is optionally a voltage comparator, similar to that shown in FIG. 2, producing an output signal when the proportional signal exceeds a predetermined threshold. When the threshold is exceeded, the angle level sensor switches to the "on" condition and actuates a following one-shot multivibrator 22 producing an azimuth beamwidth pulse at a logical "1". The duration of the logical "1" is several seconds to allow time for the source level run-by indication to be acknowledged at flip-flop 13. A countermeasure level sensor 31 is also constructed of similar components as target level sensor 11, and is preset, via its potentiometer, to switch "on", a logical "1", only when the source level voltage, coupled to input terminal 10, greatly exceeds the expected range for a real target.

Receiving signals greatly in excess of the level expected for a real target produce an overlevel pulse and indicate their origin from a decoy source. The indication of target run-by is inhibited if a decoy-like source level is present since further attacks upon a decoy are not desired. It is well known that such decoys do exist having the characteristic of radiating broadband or narrowband acoustic power at very high energy levels.

When the high level decoy is present, the countermeasure level sensor saturates to the "on" condition, a logical "1" condition. An inverter 32 transforms the logical "1" input to a logical "0" output which, in turn, is fed to a first input of a NAND element 33. Logical NAND elements perform the function of transferring a logical "1" if at least one of the inputs is "0", and a logical "0" if all the inputs are logical "1's".

It is also desirable that the target run-by detector be inhibited if pulsed-type countermeasures are in the weapon environment. Otherwise, such pulsed countermeasures when off-axis could produce the same indications on signal level and angle that are required for a real target run-by. It is very important that such false indications not be allowed to produce a run-by detection.

The presence of pulsed countermeasure energy could be indicated by an accurate gate which responds to the sharp rise and fall times of the pulses. Such a gate may be included in the weapons' AGC circuitry to produce holds on AGC action when a pulse is present, a function usually included if the weapon has active as well as massive capability.

An override pulse (logical "1") indicating the presence of an energy pulse is applied to terminal 30 in FIG. 1. This signal is then inverted (30*a*) and applied to the other input of NAND gate 33.

NAND gate 33 and the two input inverters 30*a*, and 32 function as an "OR" gate producing a logical "1" if either a high level decoy or a pulsing countermeasure is indicated. The output of NAND 33 is inverted at inverter 34 and apolied to the direct set $S_D$ terminal of the R–S connected flip-flop 35. The direct clear ($C_D$) input of flip-flop 35 is connected to the output of the one-shot multivibrator 22. Thus, the presence of either a high level decoy or pulsing countermeasure during the multivibrator 22 "ON" time sets flip-flop 35.

The flip-flop is a commercially-available unit, for example in the present application, an integrated 848 circuit coupled for actuation by asynchronous inputs (R–S connection). Setting flip-flop 35 causes the Q output to go to a logical "0", which is transmitted through gates 36 and 37, putting a logical "0" on the $C_D$ input of flip-flop 13. This inhibits flip-flop 13 from being set.

Further, if flip-flop 13 becomes set (run-by indicated) and an inhibit condition sets flip-flop 35 during the one-shot 22 "ON" time, the output of NAND gate 36 will go from "1" to "0" in turn resetting flip-flop 13 via the $C_1$ input. Thus, a run-by indication can be cut short if evidence of countermeasure influence appears.

The logic functions of J–K flip-flop 13 and flip-flop 35 are further referenced in the J–K truth table and the asynchronous truth table outlined on page 1C–52 of "The Semiconductor Data Book" (Fourth Edition), June 1969, by Motorola, Inc., Semiconductor Products Division.

The disclosed invention using simple, compact DTL circuitry with a minimal number of components is quite compact and highly reliable making it ideally suitable for use where high reliability is required.

Obviously, many modifications and variations of the present invention are possible in the light of the above teachings, and, it is therefore understood that within the scope of the disclosed inventive concept, the invention may be practiced otherwise than as specifically described.

What is claimed is:

1. A circuit for passively sensing and indicating a target run-by comprising:

means for producing a trigger signal as the magnitude of received target signals falls below a predetermined level;

means for creating an azimuth beamwidth pulse indicative of the source of said target signals being outside of a tracking angle;

means for generating an overlevel pulse representative of decoy signals having a magnitude substantially greater than expected said target signals;

logic means connected to the creating means and generating means to provide a reset signal when receiving said azimuth beamwidth pulse only and to provide an inhibit signal whenever receiving said overlevel pulse and to further provide said inhibit signal when both said azimuth beamwidth pulse and said overlevel pulse are present; and means connected to the producing means and said logic means responsive to a simultaneous said trigger signal and said reset signal to transfer a signal representative of target run-by.

2. A circuit according to claim 1 further including:

detection means connected to said logic means actuated by pulsed countermeasure signals to provide an override pulse, said logic means provides said inhibit signal upon receiving said override pulse.

3. A circuit according to claim 2 in which said logic means includes a flip-flop circuit coupled to receive said azimuth bandwidth pulse, said override pulse, and said overlevel pulse to provide an output pulse and further includes a NAND circuit coupled to receive said azimuth bandwidth pulse and said output pulse to generate said reset signal and said inhibit signal.

4. A circuit according to claim 3 in which said producing means is a comparator circuit passing a signal to a one-shot multivibrator producing said trigger signal upon receiving said target signals below said predetermined level.

5. A circuit according to claim 3 in which said generating means is a comparator circuit preset to pass said overlevel pulse upon receiving said decoy signals.

* * * * *